US006601845B2

(12) United States Patent
Lien et al.

(10) Patent No.: US 6,601,845 B2
(45) Date of Patent: Aug. 5, 2003

(54) AUTOMATIC DOCUMENT FEEDER

(75) Inventors: Szu-Hui Lien, Hsinchu (TW); Jack Lin, Hsinchu (TW)

(73) Assignee: Avision Inc., Hsinchu (TW)

( * ) Notice: Subject to any disclaimer, the term of this patent is extended or adjusted under 35 U.S.C. 154(b) by 30 days.

(21) Appl. No.: 10/021,023

(22) Filed: Dec. 19, 2001

(65) Prior Publication Data

US 2002/0081186 A1 Jun. 27, 2002

(30) Foreign Application Priority Data

Dec. 22, 2000 (TW) ..... 89222406 U

(51) Int. Cl.[7] ..... B65H 31/00
(52) U.S. Cl. ..... 271/209; 271/161
(58) Field of Search ..... 271/161, 209

(56) References Cited

U.S. PATENT DOCUMENTS 4,974,827 A * 12/1990 Arai et al. ..... 271/265.01
6,027,111 A * 2/2000 Rubscha et al. ..... 271/123

FOREIGN PATENT DOCUMENTS

JP 4 - 303345 * 10/1992 ..... B65H/3/60

* cited by examiner

*Primary Examiner*—Donald R. Walsh
*Assistant Examiner*—Kenneth W Bower
(74) *Attorney, Agent, or Firm*—Rabin & Berdo, PC

(57) ABSTRACT

An ADF with simple structure includes an input tray and elastic film. The input tray is for receiving a document to be fed and the elastic film disposed upon the input tray is for supporting the document to be fed by bounce. The elastic film includes a jointing portion for fixing the elastic film onto the input tray and a supporting portion forming an angle with the input tray for supporting the document to be fed. The elastic film further includes a bending portion, wherein one end of the bending portion connects to the supporting portion and the other end of bending portion bends towards the input tray.

13 Claims, 6 Drawing Sheets

AUTOMATIC DOCUMENT FEEDER

This application incorporates by reference Taiwanese application Serial No. 089222406, Filed Dec. 22, 2000.

BACKGROUND OF THE INVENTION

1. Field of the Invention

The invention relates in general to an Automatic Document Feeder (ADF), and more particularly to an ADF using a supporting structure for feeding documents smoothly.

2. Description of the Related Art

Feeding documents smoothly is important for every machine equipped with an ADF (Automatic Document Feeder), such as scanners, printers, facsimile machines or the like. The scanner with an ADF can carry a large amount of documents ready for use at a time, which is more efficient than the flatbed scanner does. Compared with the traditional machine, which is restricted by the image processing speed and memory capacity, the machine nowadays, requires more documents at a time for an efficient and timesaving operation, especially for office automation. However, there are restrictions of the traditional feeding device under some circumstances. For example, the document to be fed might not contact with the feed roller for being carried when the space of the input tray is large but there are only a little documents put in the input tray. The supporting structure is therefore developed for being fixed on the input tray.

Referring to FIG. 1A, a cross-sectional view of a conventional ADF is illustrated. As shown in FIG. 1A, the ADF 100 may be applied in scanners, printers, facsimile machines or the like for feeding the document 102 to the machines. The ADF 100 includes an input tray 104, a feed roller 106, a feed pad 110, a flat board 108 and a spring 111. The input tray 104 is for receiving a document 102. One end of the flat board 108 is pivoted on the input tray 104 by a hinge 115. Besides, one end of the spring 111 is fixed on the flat board 108 while the other end of the spring 111 is fixed on the notch 113 of the input tray 104. The flat board 108 and the input tray 104 therefore form an angle θ1. The rim of the feed roller 106 touches the feed pad 110. The feed roller 106 and the feed pad 110 therefore create a feeding end 112. When the feed roller 106 rotates around the axis 116, the feed roller 106 drives the document 102 to advance by fiction. The more documents the flat board 108 carries, the smaller the angle θ1 is. The flat board 108 supports the document 102 by the elasticity of the spring 111. The leading edge of the document 102 gets into the feeding end 112 so that the feed roller 106 can drive the document 102 to advance while rotating.

Referring to FIG. 1B, a cross-sectional view of the ADF in FIG. 1A which carries a stack of documents is shown. As shown in FIG. 1B, documents 114 are placed on the input tray 104. The documents 114 include a document 102*a*, document 102*b*, documents 114*a* and document 102*c*. The documents 114 in FIG. 1B are a stack of paper and the document 102 in FIG. 1A is a sheet. The documents 114 are therefore heavier than the document 102. Besides, the gravity of the stack of paper 114 downward is far larger than the elasticity of the elastic film 108 upward. The angle θ2 between the flat board 108 and the input tray 104 is less than θ1. The leading edge of the document 102*a* gets into the feeding end 112.

When the feed roller 106 starts to rotate around the axis 116, the feed roller 106 drives the document 102*a* to advance toward the feeding end 112. After the document 102*a* completely passes through the feeding end 112, the elasticity from the spring 111 pushes the document 102*b* upward for getting into the feeding end 112. The document 102*b* is then driven to pass through the feeding end 112 by the feed roller 106. The same operation will be proceeded and the amount of the documents 114 therefore gradually decreases, meanwhile, the angle θ2 between the flat board 108 and the input tray 104 becomes larger. The feed roller 106 drives the rest of documents put on the input tray 104 to advance toward the feed end 112 sequentially.

After the feed roller 106 drives the document 102*a*, document 102*b* and documents 114*a* to sequentially pass through the feeding end 112 and to be completely fed into the machine (not shown). The last document 102*c* is left on the input tray 104 and the angle θ2 between the flat board 108 and the input tray 104 becomes equal to θ1 due to the upward elasticity of the spring 111. The leading edge of document 102*c* gets into the feeding end 112 for being fed 102 and the feeding process of the ADF 100 is therefore finished.

Nevertheless, the ADF 100 stated above with a pivotal flat board, hinge and spring is structurally complex, costly and difficult to assemble during manufacturing.

SUMMARY OF THE INVENTION

It is therefore an object of the invention to provide an Automatic Document Feeder with an elastic film for supporting the documents put on the input tray, the documents are able to be carried by the feed roller for being fed smoothly and sequentially.

The invention achieves the above-identified objects by providing an ADF, which includes an input tray and elastic film. The input tray is for receiving a document or documents to be fed and the elastic film disposed upon the input tray is for supporting the document or documents to be fed by bounce. The elastic film includes a jointing portion for fixing the elastic film onto the input tray and a supporting portion forming an angle with the input tray for supporting the document or documents to be fed. The elastic film further includes a bending portion, wherein one end of the bending portion connects to the supporting portion and the other end of bending portion bends towards the input tray.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENTS

Figure 1A:
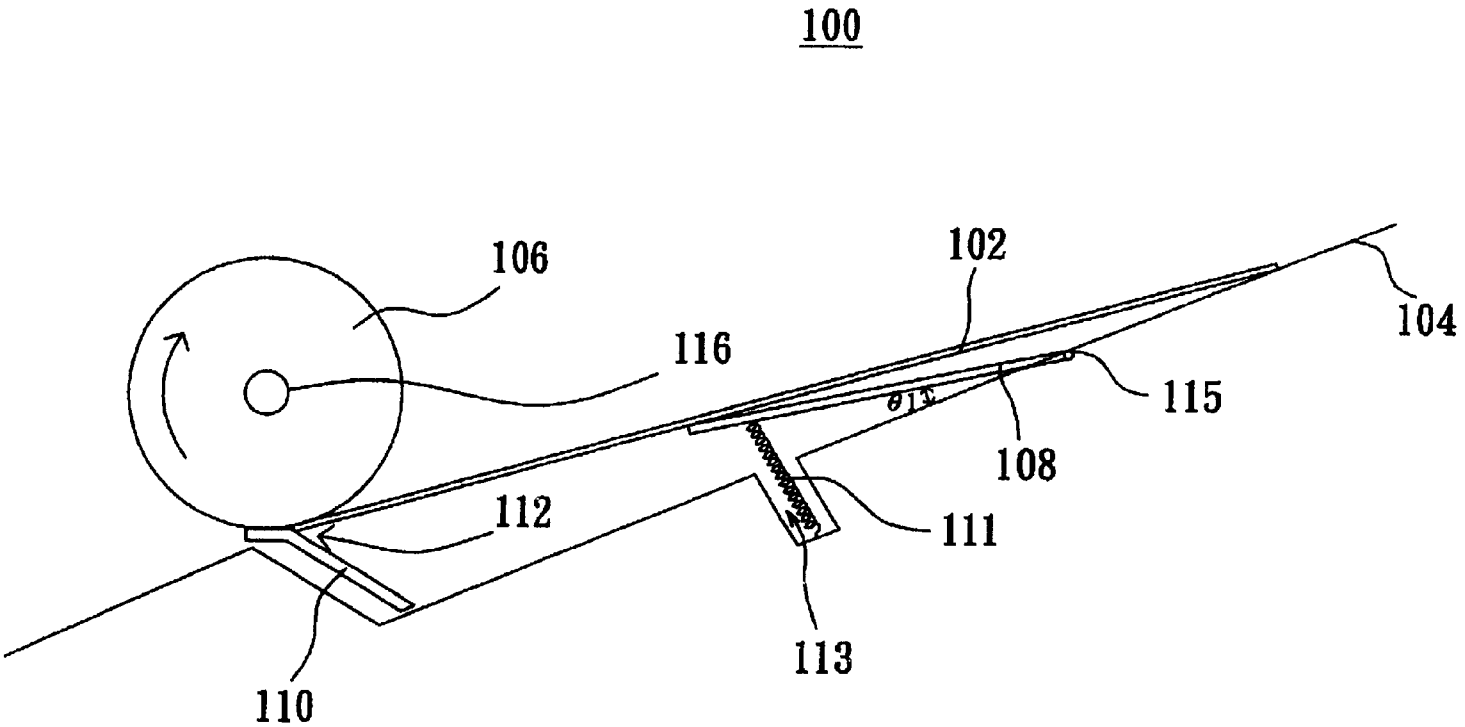
FIG. 1A (PRIOR ART)
FIG. 1A (Prior Art) illustrates a cross-sectional view of a conventional ADF.
Figure 1B:
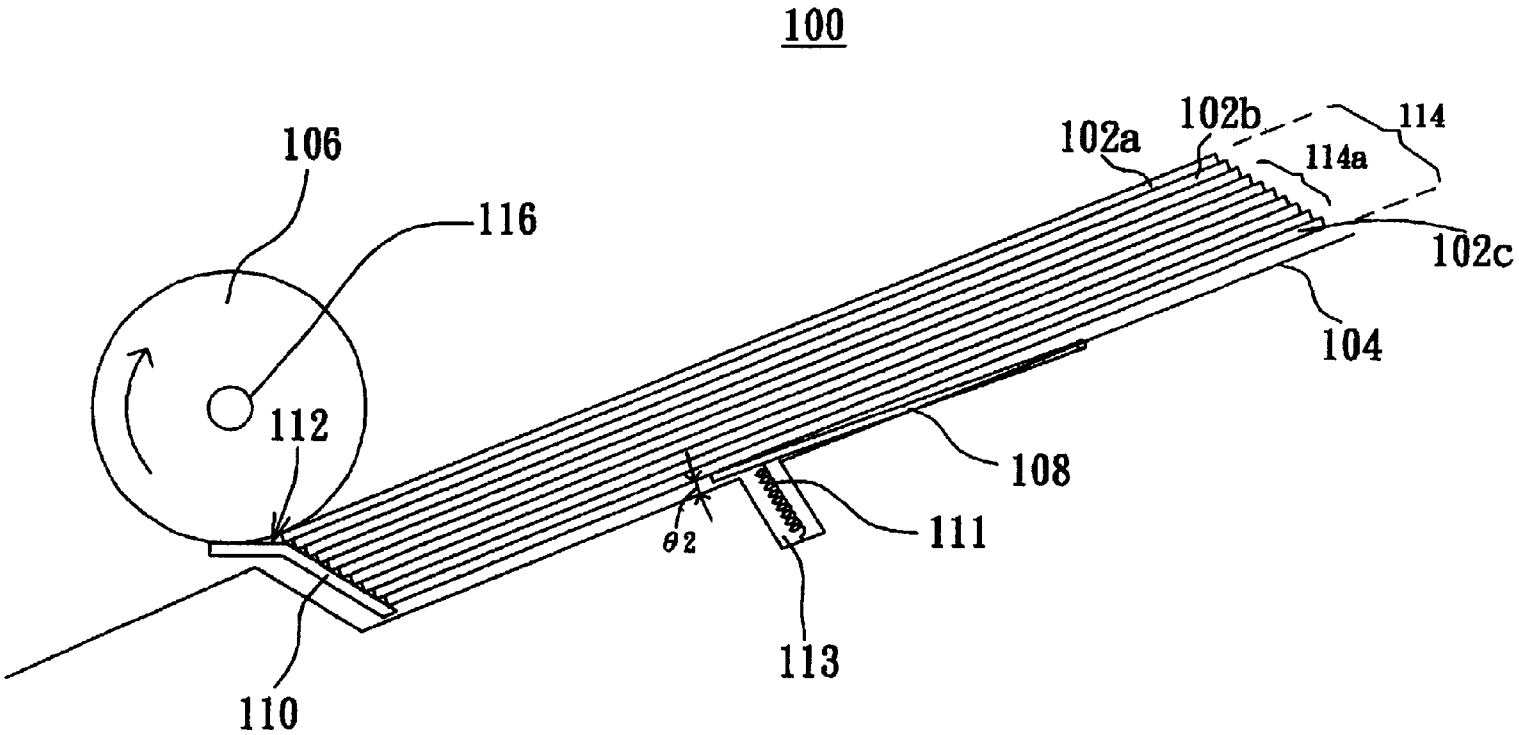
FIG. 1B (PRIOR ART)
FIG. 1B (Prior Art) shows a cross-sectional view of the conventional ADF in FIG. 1A, which carries a stack of documents.
Figure 2A:
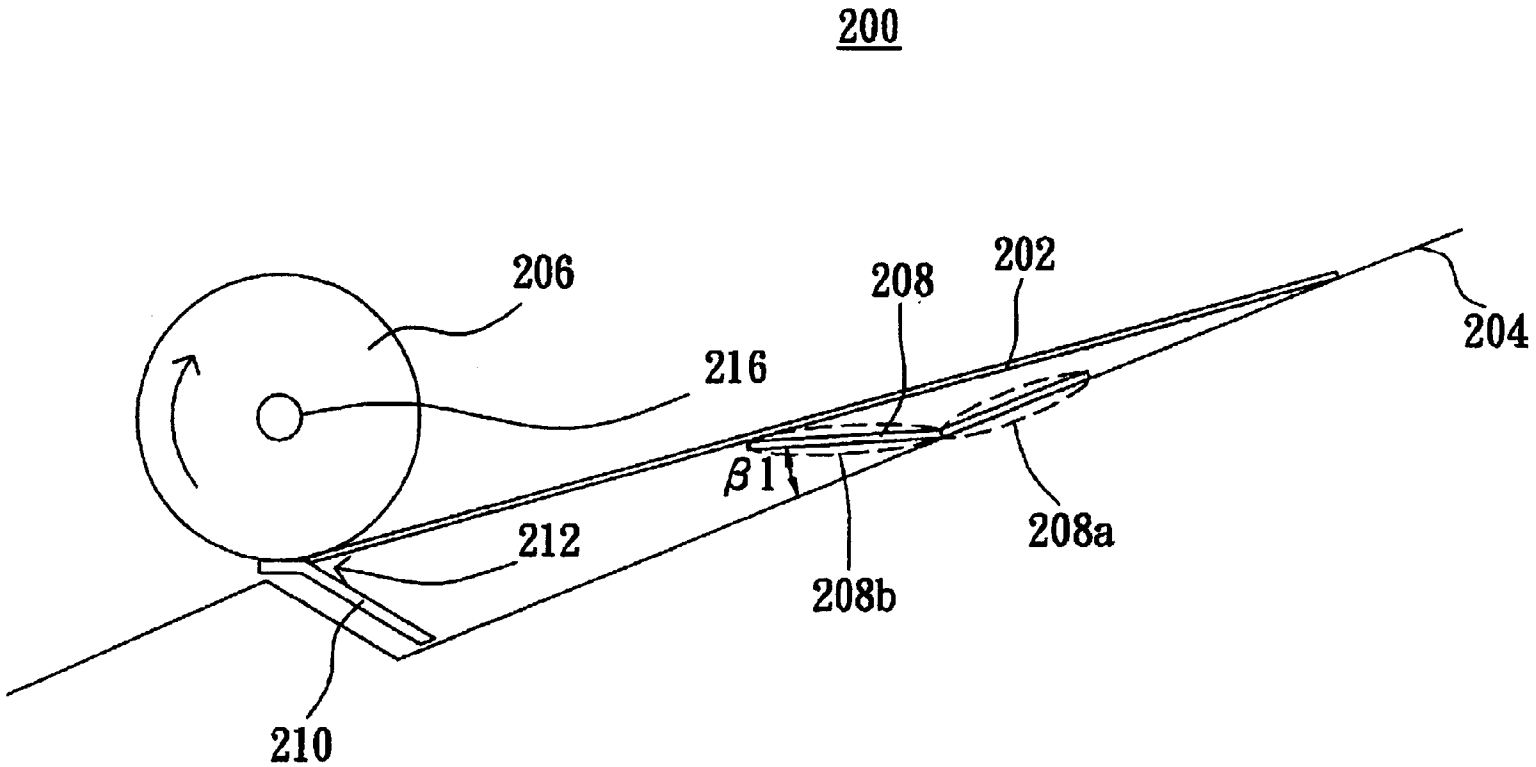
FIG. 2A is a cross-sectional view of an ADF according to a preferred embodiment of the invention.

Referring to FIG. 2A, an ADF according to a preferred embodiment of the invention is shown. The ADF (Automatic Document Feeder) 200 may be applied in scanners, printers, facsimile machines or the like for feeding the document 202 to the machines. The ADF according to the invention includes an input tray 204, a feed roller 206, a feed pad 210 and an elastic film 208. The input tray 204 is for receiving a document to be fed. The elastic film 208 disposed upon the input tray 204 supports the document 202 by bounce. The feed pad 210 connects to the bottom of the input tray 204 for abutting against the document 202 at its leading edge. The rim of the feed roller 206 touches the feed pad 210. The feed roller 206 and the feed pad 210 therefore create a feeding end 212. When the feed roller 206 rotates around the axis 216, the feed roller 206 drives the document 202 to advance by fiction. The elastic film 208 further includes a jointing portion 208*a* and a supporting portion 208*b*. The jointing portion 208*a* fixes the elastic film 208 onto the input tray 204. The supporting portion 208*b* supports the document 202 and forms an angle β1 with the input tray 204. The more documents the elastic film 208 carries, the smaller the angle β1 is. The elastic film 208 supports the document 202 by bounce. The leading edge of the document 202 gets into the feeding end 212 so that the feed roller 206 can drive the document 202 to advance while rotating.

Figure 2B:
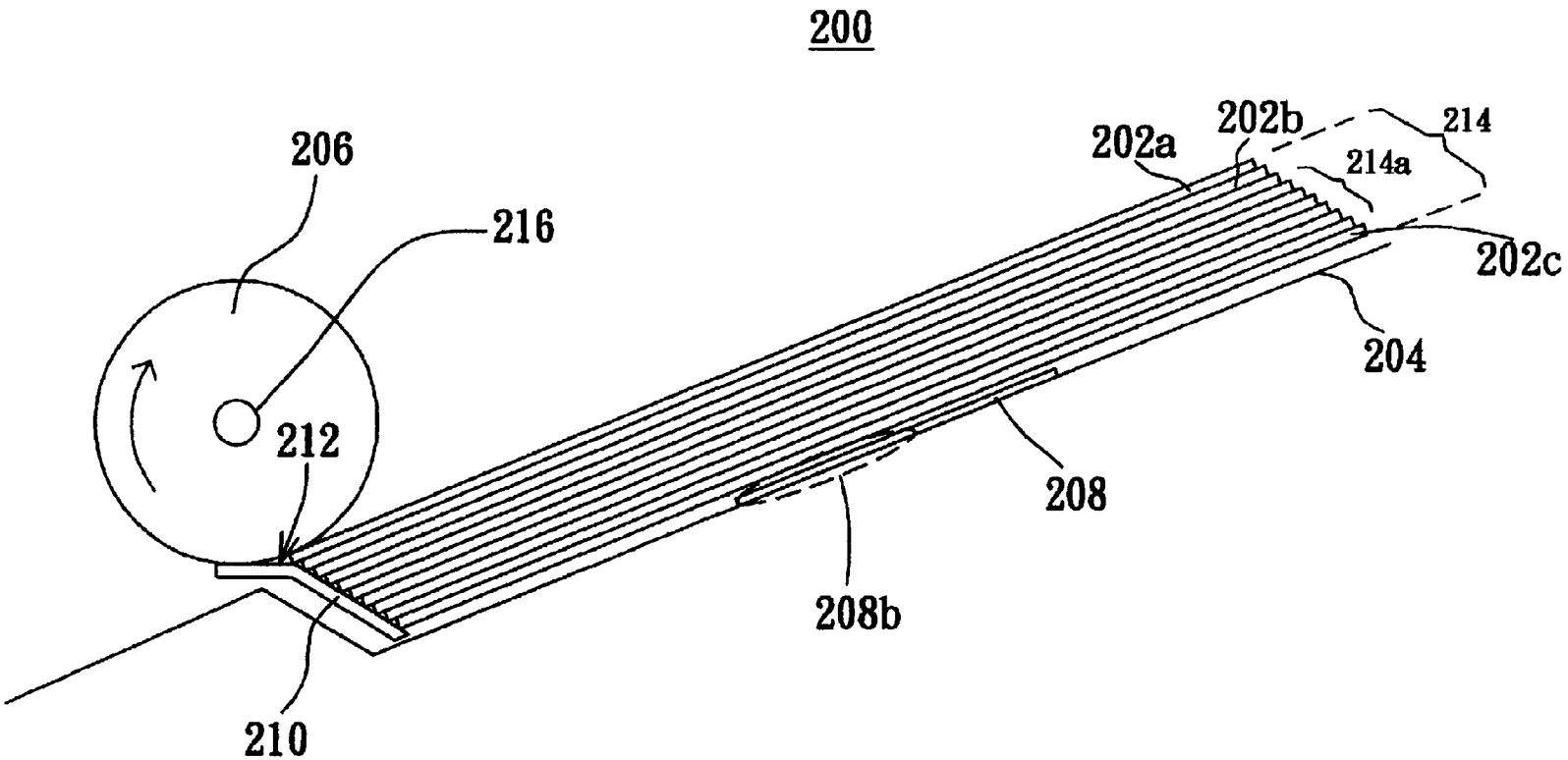
FIG. 2B shows a cross-sectional view of the ADF in FIG. 2A, which carries a stack of documents.

Referring to FIG. 2B, a cross-sectional view of the ADF in FIG. 2A which carries a stack of documents is shown. In FIG. 2B, documents 214 are placed on the input tray 204. The documents 214 include a document 202*a*, document 202*b*, documents 214*a* and document 202*c*. The documents 214 in FIG. 2B are a stack of paper and the document 202 in FIG. 2A is a sheet. The documents 214 are therefore heavier than the document 202. Besides, the gravity of the stack of paper 214 downward is far larger than the elasticity of the elastic film 208 upward. The angle β2 (not shown in FIG. 2B) between the supporting portion 208*b* and the input tray 204 is less than β1. It causes the supporting portion 208*b* of the elastic film 208 approaches the input tray 204 and the leading edge of the document 202*a* can neatly get into the feeding end 212.

When the feed roller 206 starts to rotate around the axis 216, the feed roller 206 drives the document 202*a* to advance toward the feeding end 212. After the document 202*a* completely passes through the feeding end 212, the elasticity of the elastic film 208 pushes the document 202*b*, documents 214*a* and document 202*c* upward. The leading edge of the next document 202*b* neatly gets into the feeding end 212 and the document 202*b* is then driven to pass through the feeding end 212 by the feed roller 206. The same operation will be done on each document. Therefore, the amount of the documents 214 gradually decreases, meanwhile, the angle β2 between the supporting portion 208*b* and the input tray 204 becomes larger. The feed roller 206 can drive the rest of documents put on the input tray 204 to advance and to be fed smoothly and sequentially by the support of the elastic film 208.

After the feed roller 206 drives the document 202*a*, document 202*b* and documents 214*a* to sequentially pass through the feeding end 212 and be completely fed into the machine. The last document 202*c* is left on the input tray 204 and the angle β2 between the supporting portion 208*b* and the input tray 204 becomes equal to β1 due to the upward elasticity of the elastic film 208. The leading edge of document 202*c* can get into the feeding end 212 and the feeding process of the ADF 200 is therefore finished.

Figure 3A:
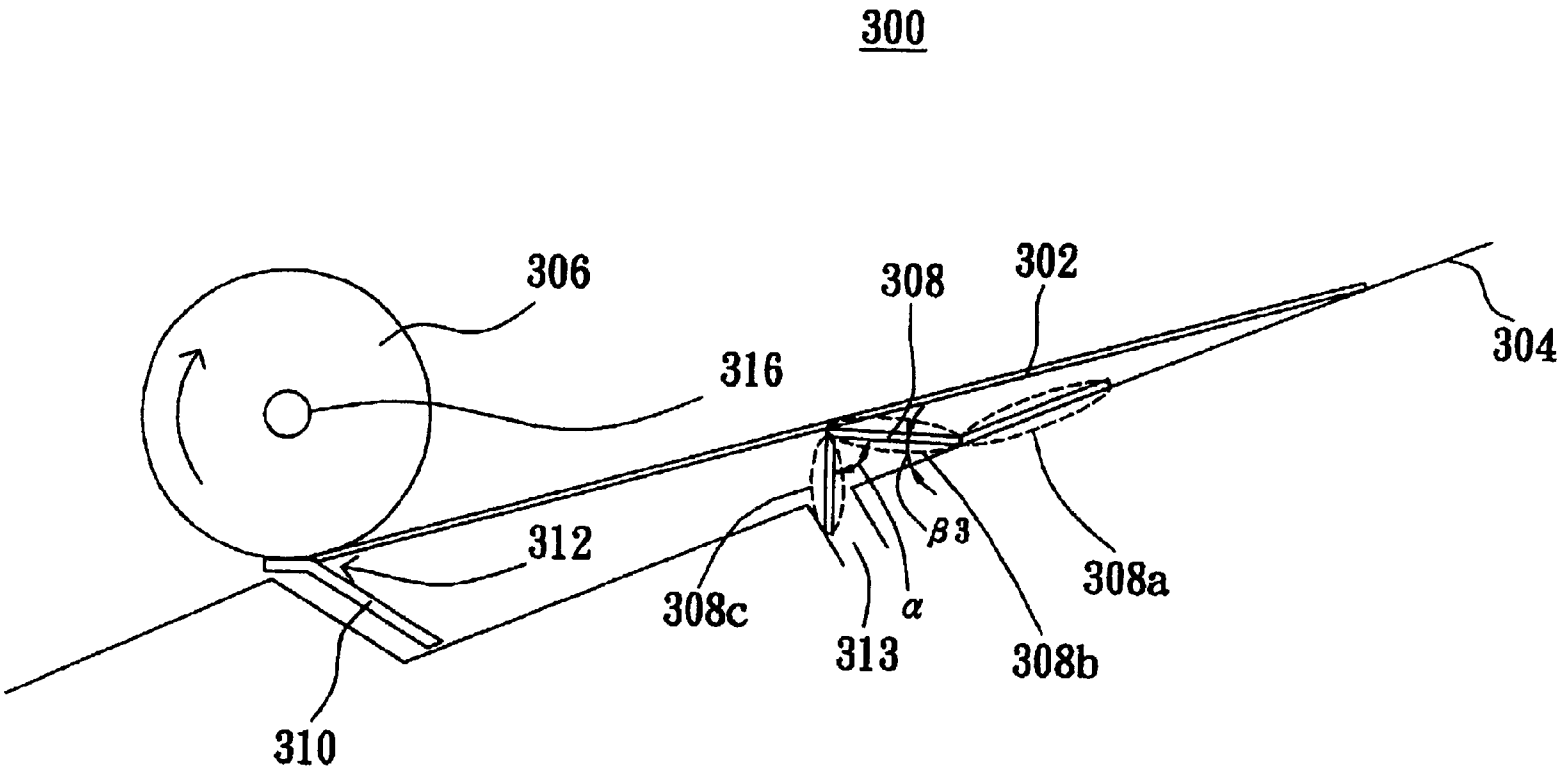
FIG. 3A is a cross-sectional view of an ADF according to another preferred embodiment of the invention.

Referring to FIG. 3A, an ADF according to another preferred embodiment of the invention is shown. The ADF may be applied in scanners, printers, facsimile machines or the like for feeding the document 302 to the machines. As shown in FIG. 3A, the ADF 300 according to the invention includes an input tray 304, a feed roller 306, a feed pad 310 and an elastic film 308. The input tray 304 is for receiving a document 302. The elastic film 308 disposed upon the input tray 304 supports the document 302 by bounce. The feed pad 310 connects to the bottom of the input tray 304 for abutting against the document 302 at its leading edge. The rim of the feed roller 306 touches the feed pad 310. The feed roller 306 and the feed pad 310 therefore create a feeding end 312. When the feed roller 306 rotates around the axis 316, the feed roller 306 drives the document 302 to advance by friction. The elastic film 308 further includes a jointing portion 308*a*, a supporting portion 308*b* and a bending portion 308*c*. The jointing portion 308*a* fixes the elastic film 308 onto the input tray 304. The supporting portion 308*b* supports the document 302 and forms an angle β3 with the input tray 304. The supporting portion 308*b* and the bending portion 308*c* are linked together and form an angle α. The angle α is stationary or variable while the angle β3 is variable. Besides, one end of the bending portion 308*c* gets into the notch 313 of the input tray 304 and slides down the notch 313 while the supporting portion 308*b* is pressed by the document to be fed. As the elastic film 308 carries more and more documents, the angle β3 becomes less and less as well as the bending portion 308*c* moves deeper and deeper inside the notch 313. The elastic film 308 supports the document 302 by bounce. The leading edge of the document 302 gets into the feeding end 312 so that the feed roller 306 can drive the document 302 to advance while rotating.

Figure 3B:
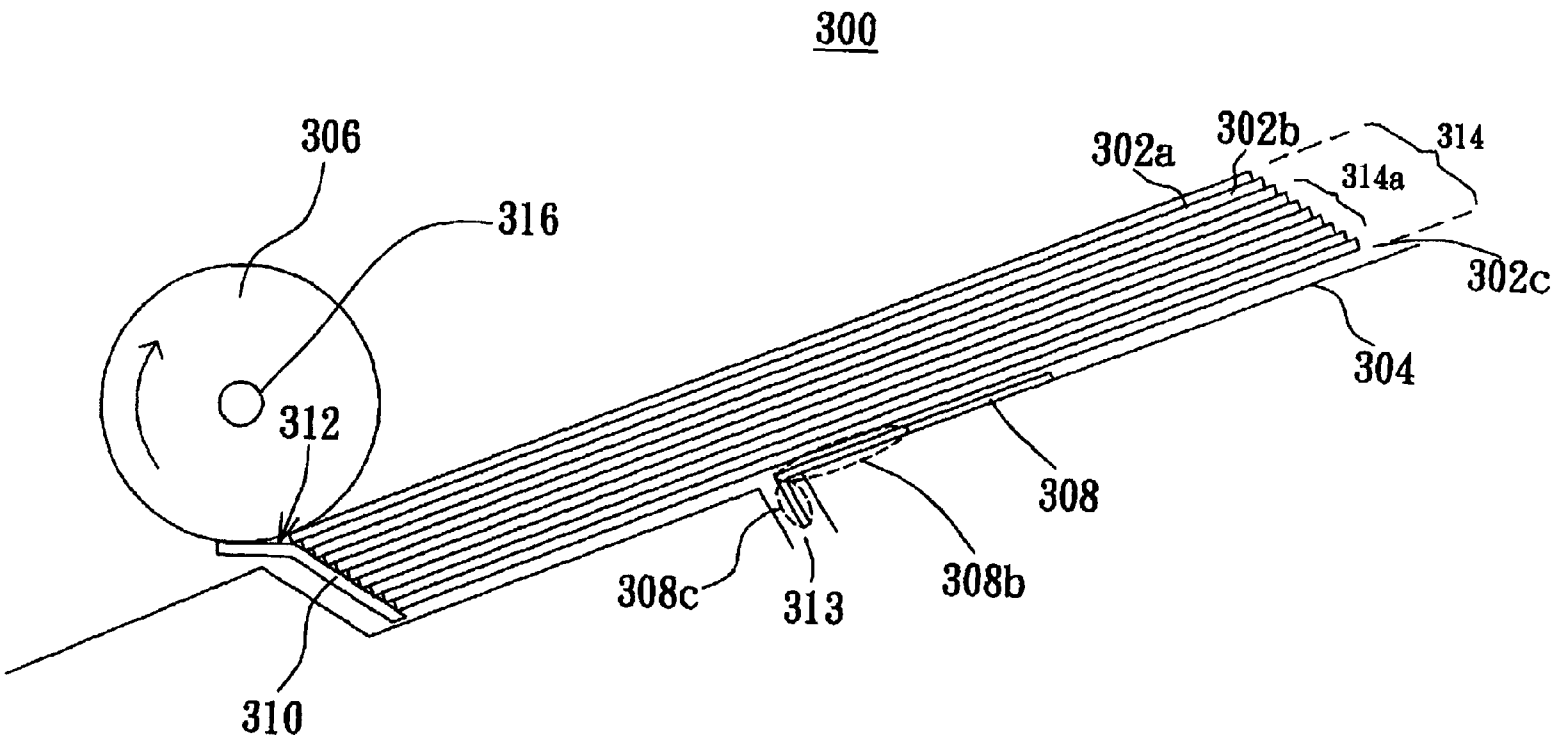
FIG. 3B shows a cross-sectional view of the ADF in FIG. 3A, which carries a stack of documents.

Referring to FIG. 3B, a cross-sectional view of the ADF in FIG. 3A which carries a stack of documents is shown. In FIG. 3B, documents 314 are placed on the input tray 304. The documents 314 include a document 302*a*, document 302*b*, documents 314*a* and document 302*c*. The documents 314 in FIG. 3B are a stack of paper and the document 302 in FIG. 3A is a sheet. The documents 314 are therefore heavier than the document 302. Besides, the gravity of the stack of paper 314 downward is far larger than the elasticity of the elastic film 308 upward. The angle β4 (not shown in FIG. 3B) between the supporting portion 308*b* and the input tray 304 is less than β3. The bending portion 308*c* moves insides the notch 313 so that it causes the supporting portion 308*b* approaches the input tray 304 and the bending portion 308*c* almost gets into the notch 313. Meanwhile, the leading edge of the document 302*a* can neatly get into the feeding end 312 and the leading edges of the documents 314 touches the feeding pad 310.

When the feed roller 306 starts to rotate around the axis 316, the feed roller 306 drives the document 302*a* to advance toward the feeding end 312. After the document 302*a* completely passes through the feeding end 312, the elasticity of the elastic film 308 pushes the document 302*b*, documents 314*a* and document 302*c* upward. The leading edge of the next document 302*b* neatly gets into the feeding end 312 and the document 302*b* is then driven to pass through the feeding end 312 by the feed roller 306. The same operation will be done on each document. Therefore, the amount of the documents 314 gradually decreases, meanwhile, the angle β4 between the supporting portion 308*b* and the input tray 304 becomes larger. The feed roller 306 can drive the rest of documents put on the input tray 304 to advance and to be fed smoothly and sequentially by the support of the elastic film 308.

After the feed roller 306 drives the document 302*a*, document 302*b* and documents 314*a* to sequentially pass through the feeding end 312 and be completely fed into the machine. The last document 302*c* is left on the input tray 304 and the angle β4 between the supporting portion 308*b* and the input tray 304 becomes equal to β3 due to the upward elasticity of the elastic film 308. The leading edge of document 302*c* can get into the feeding end 312 for being fed by the driving of the feed roller 306 and the feeding process of the ADF 300 is therefore finished.

The elastic film is a polyester film and preferably a Mylar. In addition, the elastic film is firmly attached to the input tray so that the elastic film would not be loosed or damaged by the friction produced by the moving document.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An automatic document feeder, comprising:

an input tray for receiving a document to be fed; and an elastic film disposed upon the input tray, for supporting the document to be fed, the elastic film comprising:

a jointing portion for fixing the elastic film onto the input tray; and a supporting portion forming an angle with the input tray for supporting the document to be fed.

2. The automatic document feeder according to claim 1 further comprising:

a feed pad connected to a bottom of the input tray for abutting against the document to be fed at its leading edge.

3. The automatic document feeder according to claim 2 further comprising:

a feed roller for driving the document to be fed, wherein a rim of the feed roller touches the feed pad.

4. The automatic document feeder according to claim 1, wherein the elastic film is a polyester film.

5. The automatic document feeder according to claim 1, wherein the document to be fed is a sheet.

6. The automatic document feeder according to claim 1, wherein the document to be fed is a stack of paper.

7. An automatic document feeder, comprising:

an input tray for receiving a document to be fed; and an elastic film disposed upon the input tray, for supporting the document to be fed, the elastic film comprising:

a jointing portion for fixing the elastic film onto the input tray;

a supporting portion forming an angle with the input tray for supporting the document to be fed; and a bending portion, wherein one end of the bending portion connects to the supporting portion and the other end of bending portion bends towards the input tray.

8. The automatic document feeder according to claim 7, wherein the input tray further has a notch for receiving the bending portion.

9. The automatic document feeder according to claim 7, wherein the bending portion slides down the notch while the supporting portion is pressed by the document to be fed.

10. The automatic document feeder according to claim 7 wherein the elastic film is a polyester film.

11. The automatic document feeder according to claim 7 further comprising:

a feed pad connected to a bottom of the input tray for abutting against the document to be fed at its leading edge; and a feed roller for driving the document to be fed, wherein a rim of the feed roller touches the feed pad.

12. The automatic document feeder according to claim 7, wherein the document to be fed is a sheet.

13. The automatic document feeder according to claim 7, wherein the document to be fed is a stack of paper.

* * * * *